United States Patent [19]

Price et al.

[11] 4,025,369

[45] May 24, 1977

[54] DEFLAGRATIVE EPOXY FOAM MATERIAL

[75] Inventors: Luther A. Price, Phoenix, Ariz.; Theodore N. Bryla, Glendora, Calif.

[73] Assignee: The United States of America as represented by the Secretary of the Navy, Washington, D.C.

[22] Filed: Jan. 22, 1973

[21] Appl. No.: 329,260

Related U.S. Application Data

[63] Continuation-in-part of Ser. No. 113,749, Feb. 8, 1971, abandoned.

[52] U.S. Cl. ..... 149/19.6; 149/2; 149/83; 102/90; 109/36

[51] Int. Cl.[2] ..... C06B 45/10

[58] Field of Search ..... 149/19, 19.6; 102/90; 109/36

[56] References Cited

UNITED STATES PATENTS

| | | | |
|---|---|---|---|
| 3,049,454 | 8/1962 | Stark | 149/2 |
| 3,171,764 | 3/1965 | Parker et al. | 149/19 |
| 3,198,677 | 8/1965 | Thomas | 149/2 X |
| 3,301,187 | 1/1967 | Donaldson et al. | 149/19 X |
| 3,398,215 | 8/1968 | Spenadel et al. | 149/2 X |

*Primary Examiner*—Stephen J. Lechert, Jr.
*Attorney, Agent, or Firm*—Richard S. Sciascia; Joseph M. St.Amand

[57] ABSTRACT

A destructible packaging epoxy foam composition used for electrical and thermal insulation in electronic equipment, and containing a pyrotechnic component such that when ignited the foam will sustain combustion for destroying the electronic components adjacent to the foam material.

6 Claims, No Drawings

DEFLAGRATIVE EPOXY FOAM MATERIAL

CROSS REFERENCE TO RELATED APPLICATIONS

This is a Continuation in Part of U.S. patent application Ser. No. 113,749, filed 8 Feb., 1971, now abandoned.

This invention is related to copending U.S. patent application Ser. No. 113,705 for Deflagrative Electronic Component Potting Compound, filed 8 Feb. 1971; and U.S. patent application Ser. No. 113,704 for Deflagrative Circuit Board Material, filed 8 Feb., 1971, now U.S. Pat. No. 3,740,277 issued 19 June 1973.

BACKGROUND OF THE INVENTION

This invention provides light weight cellular structural plastic foams which have desirous electrical, thermal, insulating, and mechanical physical properties for usage as electrical and thermal insulator materials to separate and protect delicate electronics equipment and components, yet when ignited for anticompromise destruct purposes will sustain combustion and contribute to the destruction of electronic materials, etc., assembled adjacent to the foam material.

Light weight cellular structural plastic materials have been produced by making solid foam from various resin materials. The resin materials generally consist of two or three liquid components which when properly mixed and cured will produce a light weight cellular structural plastic foam. These foam materials are formulated and processed such that they are flame retardant.

An object of this invention is to provide a light weight cellular structural plastic foam material with requisite electrical, thermal insulation properties, mechanical and physical properties, but will sustain combustion when ignited.

It is also an object of this invention to provide a dual purpose foam material to both provide light weight packaging material with good thermal and insulating properties, and using the same space requirements for normal packaging provide a noncatastrophic destruction of nearby materials when ignited.

Other objects and many of the attendant advantages of this invention will become readily appreciated as the same becomes better understood by reference to the following detailed description wherein:

DESCRIPTION OF THE PREFERRED EMBODIMENT

A representative formulation of the deflagrative foamed plastic composition of this invention is as follows:

The following ingredients are thoroughly mixed together at room temperature.

- 42% by weight of potassium perchlorate (44 micron particle size),
- 7.5% by weight of toluene (foaming agent),
- 1% by weight of dinitrosopentamethylene tetramine (foaming agent),
- 4.5% by weight of diethylene triamine,
- 1% by weight of polyoxyethylene sorbitan monolaurate (e.g. Tween 20 by Sigma Chemical Company),
- 44% by weight of a solid diglycide ether of bisphenol A resin (e.g. Epon 1001 by Shell).

Upon completion of the thorough mixing of the above ingredients the mixture is sequentially foamed and cured by placing in an oven at 190° C for 15 minutes.

The material can be formed in moulds as desired, or formed around the assemblies to be protected.

Epon 1001 is an epichlorohydrin/bisphenol A-type solid epoxy resin that softens slightly above room temperature. It has an average molecular weight (approx.) of 900. Other brands of polymeric diglycide ether of bisphenol A of approximately the same molecular weight can also be used as the solid epoxy resin.

The foam is prepared as follows: The solid diglycide ether of bisphenol A resin (usually in flake form) is heated with a slight excess of toluene until a uniform solution is obtained. This solution is not allowed to boil. Continue to heat, weighing at intervals, until the excess of toluene is removed by evaporation. Remove from heat and stir in the polyoxyethylene sorbitan monolaurate, potassium perchlorate, dinitrosopentamethylene tetramine and diethylene triamine, one at a time, in the given order. Place a layer of the mixture ⅛ to ¼ inch in thickness in a desired container and place the container in an oven at 190° C for 15 minutes. As the formulation heats, it will first foam, then cure as it is heated. Remove from oven and cool; no further processing is required. Also, the mixture can be poured directly about electronic equipment and components and then foamed in place, as desired.

The combination of an oxidizer with a foamed in place epoxy resin which acts as a fuel, produces the novel pyrotechnics of this invention. This provides a novel deflagrative foam material that possesses deflagrative and destruct properties in conjunction with its other desirous electrical, chemical, mechanical and physical properties to permit the material to be used in a normal manner in electronic assemblies and upon ignition to serve as a heat source for the non-catastrophic destruct action of electronic components.

The ignition of the deflagrative material can be by hot wire, pyro fuze or electric squib techniques accomplished by embedding or placing initiating materials such as palladium claded aluminum wire materials, flexible plastic bonded magnesium teflon compositions or lead sheathed metal-oxidant/explosive loaded cord materials into or adjacent to the deflagrative material.

Obviously, many modifications and variations of the present invention are possible in the light of the above teachings. It is therefore to be understood that within the scope of the appended claims the invention may be practiced otherwise than as specifically described.

We claim:

1. A deflagrative epoxy foam composition, for electrical and thermal insulation in electronic assemblies, which upon ignition thereof will sustain combustion to provide a heat source for the non-catastrophic destruction of the assemblies adjacent thereto, produced from:

a. an initial mixture, one at a time in the given order, of:

- 44 percent by weight of a solid diglycide ether of bisphenol A resin having an average molecular weight (approx.) of 900 dissolved in 7.5 percent by weight of toluene to form a uniform solution;
- 1 percent by weight of polyoxyethylene sorbitan monolaurate,
- 42 percent by weight of potassium perchlorate,
- 1 percent by weight of dinitrosopentamethylene tetramine, and
- 4.5 percent by weight diethylene triamine;

b. said mixture being sequentially foamed and cured by heating at 190° C for approximately 15 minutes to form a foam composition having electrical and thermal insulating and mechanical physical properties suitable for separating and protecting delicate electronic assemblies, and which will sustain, upon ignition thereof, combustion to produce heat for destroying said electronic assemblies in a noncatastrophic manner.

2. A deflagrative composition as in claim 1 wherein, rior to foaming and curing, said initial mixture is first oured directly about said electronic assemblies and ubsequently foamed and cured in place.

3. A deflagrative composition as in claim 1 wherein, rior to foaming and curing, a ⅛ to ¼ inch thick layer f said initial mixture is placed in a desired container nd subsequently foamed and cured.

4. A deflagrative composition as in claim 1 which is gnited by any of hot wire, pyro fuze, and electric squib gnition techniques wherein any of said wire, fuze and squib are embedded in or immediately adjacent to the deflagrative composition.

5. A composition for producing, upon foaming and curing thereof, a deflagrative epoxy foam for the electrical and thermal insulation of electronic assemblies, and which, upon ignition thereof, will sustain combustion for noncatastrophic destruction of said electronic assemblies, comprising a mixture of:

a. 44 percent by weight of a solid diglycide ether of bisphenol A resin having an average molecular weight (approx.) of 900 dissolved in 7.5 percent by weight of toluene to form a uniform solution;
b. 1 percent by weight of polyoxyethylene sorbitan monolaurate;
c. 42 percent by weight of potassium perchlorate;
d. 1 percent by weight of dinitrosopentamethylene tetramine; and
e. 4.5 percent by weight diethylene triamine.

6. A composition as in claim 5 which is operable to be sequentially foamed and cured by heating at 190° C for approximately 15 minutes.

* * * * *